United States Patent [19]

Buck

[11] Patent Number: 4,631,987

[45] Date of Patent: Dec. 30, 1986

[54] POWER TONGS

[76] Inventor: David A. Buck, 909 E. Bayou Pkwy., Lafayette, La. 70518

[21] Appl. No.: 760,257

[22] Filed: Jul. 29, 1985

[51] Int. Cl.[4] ..... B25B 17/00

[52] U.S. Cl. ..... 81/57.14; 81/57.2; 81/57.21; 81/57.18; 294/113; 279/109; 279/119

[58] Field of Search ..... 81/57.16, 57.34, 57.2, 81/57.21, 57.18, 57.14, 57.3, 57.15, 57.33; 269/156; 294/113, 116; 279/107, 109, 114, 119

[56] References Cited

U.S. PATENT DOCUMENTS

| | | | |
|---|---|---|---|
| 3,013,517 | 12/1961 | Isham | 294/116 |
| 3,371,562 | 3/1968 | Kelley | 81/57.18 |
| 4,084,453 | 4/1978 | Eckel | 81/57.18 |
| 4,404,876 | 9/1983 | Eckel | 81/57.18 |

*Primary Examiner*—Frederick R. Schmidt
*Assistant Examiner*—Bradley I. Vaught
*Attorney, Agent, or Firm*—John D. Jeter

[57] ABSTRACT

A power tong having a frame with an open throat at one end and a pipe gripping mechanism situated for rotation within the frame, carrying three pipe gripping dies about equally spaced around the longitudinal axis of the pipe. Only one of the pipe gripping dies is driven toward the pipe by cam action of the rotating mechanism. The other two pipe gripping dies pivot and achieve their pipe loading capability from the action of the cam driven pipe gripping die. Once the rotation of the pipe has been achieved, the rotating mechanism returns to such a position that the open throat of the rotating mechanism coincides with the open throat of the frame, whereby the pipe, having been spun, can then be released.

9 Claims, 8 Drawing Figures

POWER TONGS

The present invention relates to power tongs of the type commonly used in oil fields for making up and breaking apart threaded connections between drill pipes, casing, tubing, and the like.

RELATED PATENTS

The following patents are related to apparatus of this invention:

2,550,045, De Hetre, April, 1951; 2,846,909, Mason, August, 1958; 2,879,680, Beeman, et al., March, 1959; 3,180,186, Catland, April, 1965; 3,261,241, Catland, July, 1966; 3,371,562, Kelley, March, 1968; 3,550,485, Dickmann, December, 1970; 3,589,742, Flick, June, 1971; 3,776,320, Brown, December, 1973; 4,084,453, Eckel, April, 1978; 4,404,876, Eckel, September, 1983.

BACKGROUND OF THE INVENTION

The present invention relates to power tongs of the type commonly used to work the threaded connections of tubular goods commonly used in oil field well drilling. It is often necessary in oil field drilling operations to make and break threaded connections between joints of pipe which are used in serial order to make up drill strings, casing strings, and the like. A typical power tong includes a mechanism for gripping the external surface of a pipe section and rotating the pipe section while the pipe section to which it is connected is held stationary. The current state of the art in power tong construction is represented by the U.S. Pat. No. 4,084,453 issued to Eckel. This device functions well enough, but improvements are currently sought to better serve in the maintainability and durability of the parts most subject to wear. The parts most subject to wear are the pipe gripping dies and the means employed to force them into the pipe surface to achieve a turning ability.

Accordingly, an object of the present invention is to provide a power tong for making up and breaking apart joints of well bore tubular goods, and the like, having an improved pipe gripping mechanism and a simplified means for actuating the gripping mechanism.

It is another object of this invention to reduce the cam surface costs required to drive the pipe gripping dies into contact with the pipe surface.

It is yet another object of this invention to provide pipe gripping dies which require radial loads in a direction less inclined to strain the frame of the power tong system.

These and other objects, advantages, and features of this invention will be apparent to those skilled in the art from a consideration of this specification, including the attached drawings and appended claims.

SUMMARY OF THE INVENTION

The apparatus of the present invention provides a power tong resembling a large end wrench with an opening or throat in one end to receive a pipe. Within the frame, a pipe gripping mechanism consists primarily of two partial rings, which rotate one relative to the other to move pipe grip elements against the pipe, then rotate collectively within the frame to apply torque to rotate the pipe. When the pipe rotation is completed, the pipe gripping mechanism, again involving primarily the two partial rings, can be rotated backward to release pipe gripping dies and align all throat openings.

Of the two cooperating partial rings, the primary ring actuates the dies and conducts the torque required to rotate the pipe. The secondary ring carries the dies to grip the pipe before rotating collectively with the primary ring to carry out the total pipe turning effort. Collective rotation is forced when the pipe gripping elements engage the pipe surface, and the torque used to load the gripping elements exceeds the resisting torque required for pipe rotation.

THE IMPROVEMENT

Prior art, as evolved, has resulted in the use of two opposed pipe gripping dies, driven radially toward the pipe by identical camming surfaces on the primary ring. Apparatus of the present invention is an improvement in that one cam surface on the primary ring drives a single die radially toward the pipe, and two additional pipe gripping dies pivot on the secondary ring as urged by cam follower on the first pipe gripping die. To interfere with movement of the pipe radially out of the opening, all three dies, once in action, are distributed peripherally about the pipe being worked. All three dies are about equally spaced around the pipe periphery.

The primary partial ring of existing power tongs have two cam surfaces diametrically opposed. Since a throat type opening must exist to admit the pipe, the opposed cam surfaces tend to spring the primary ring open. This ring is gear driven and does not operate well when distorted.

Since cam surfaces in opposition do not cumulatively contribute load but do cumulatively require power to operate, there is an efficiency loss.

The single cam surface on the primary ring of the present invention can be located opposite the necessary opening or throat for the pipe, and this does not strain the ring from opposed forces. The two additional dies are pivoted from axes mounted on the secondary ring. The secondary ring is commonly brake controlled rather than gear driven, and some strain can easily be tolerated.

The novel and improved features of the apparatus of this invention can be realized by mounting the primary and secondary partial rings and the associated pipe gripping dies within the frames of existing power tongs. A typical and suitable frame is disclosed in the U.S. Pat. No. 4,404,876 and, by reference, that patent is made part of this specification. The power train of U.S. Pat. No. 4,404,876 discloses the throat opening negotiating gear train now in widespread use to drive rotating machinery in throated power tongs and, as existing art, is utilized in the present invention.

DETAILED DESCRIPTION OF DRAWINGS

Figure 1:
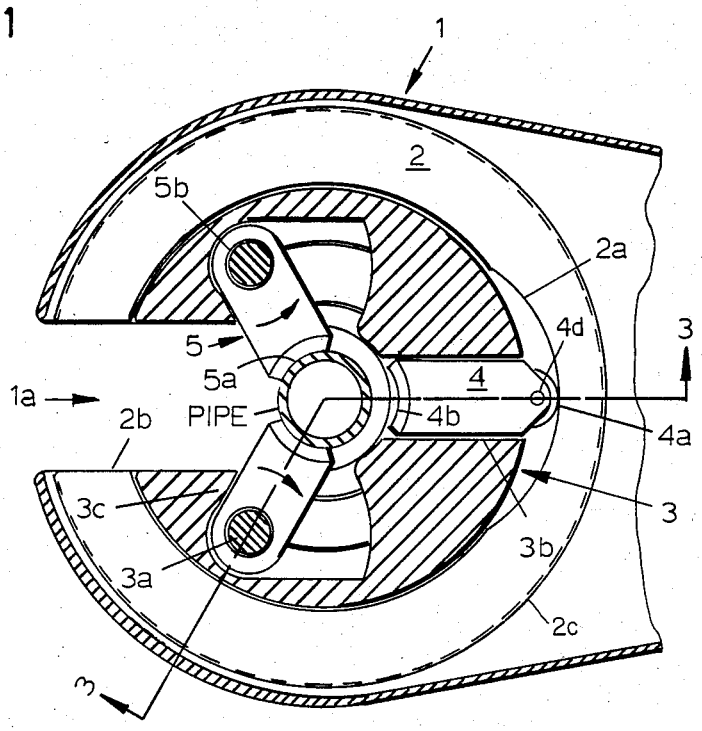
FIG. 1 represents a plan view in partial cutaway of the apparatus of this invention.

In FIG. 1, the principal points of novelty of the apparatus of this invention involves primary partial ring 2, secondary partial ring 3, the single cam operated assembly 4, pivoting dies 5 and the directly associated machine elements. Primary partial ring 2 is situated for rotation within frame 1, about the longitudinal centerline of the pipe, as shown. Secondary partial ring 3 is situated within frame 1, and may be mounted either on frame 1 or on primary partial ring 2 for rotation relative to both the frame and the primary ring, about the pipe longitudinal axis. Ring 2 is the principal driving force powered by means not shown to rotate the pipe. The secondary partial ring 3 is used to stabilize the dies until ring 2 has caused the pipe to be gripped on its outer surface. On ring 2, cam surfaces 2*a*, when the ring 2 is rotated relative to ring 3, acts upon the cam follower pipe gripping die combination 4 by contacting surface 4*a* and urging surface 4*b* toward the pipe outer surface. The cam surfaces preferred are cylindrical surfaces having an axis of generation parallel the axis of rotation of partial ring 2 located between the axis of rotation of partial ring 2 and the cam surfaces. The two pivoting pipe gripping dies 5 are shown out of the usual position. They are biased away from the pipe, by a spring described later, in the direction shown by the arrows on these dies, such that the pipe can move leftward out of a throat in frame 1 and opening 2*b* of ring 2 when these openings are correctly aligned.

Pipe gripping dies 5 are rotated into the position shown when the die combination 4 is moved toward the pipe centerline from the position shown. Coordination of this movement is explained later.

It should be noted that the pivoting dies and the cam follower combination 4 can be changed to accommodate pipes of different outside diameters. Cam surface 4*a* is on a roller secured by pin 4*d*, and the roller alone can be changed to compensate for small changes in pipe diameter and to replace the cam follower surface. When properly selected in terms of dimension, dies 5 will assume about the position shown when the pipe is pushed leftward by die combination 4. In that position, the force applied to the pipe is influenced by the angle of a line connecting pivot post 3*a* and the pipe centerline relative to a radial line generally centralized along the die combination 4 and extending radially out the throat.

Figure 2:
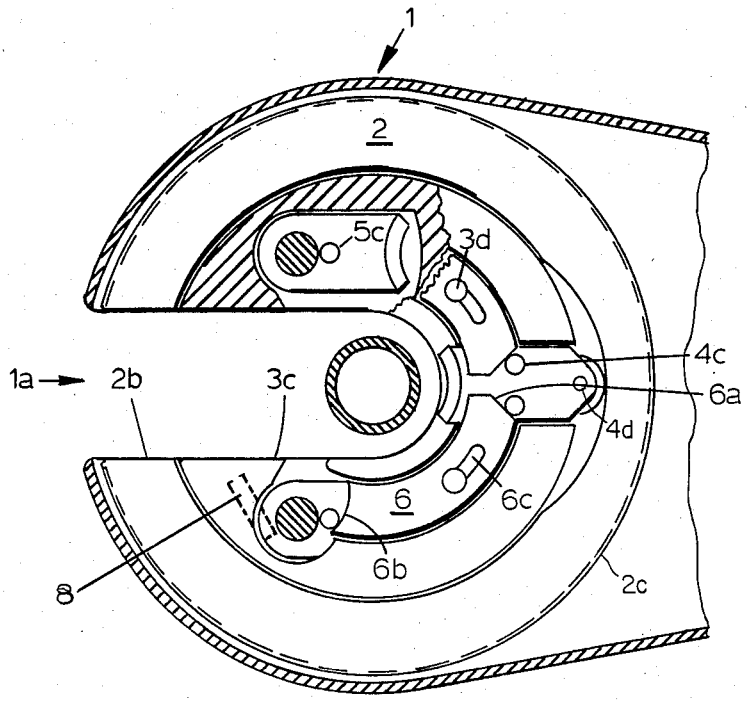
FIG. 2 represents the same apparatus of FIG. 1 from the opposite side with some structure cut away.

FIG. 2 is the opposite side of FIG. 1, and as commonly used, will represent the underside of the power tong assembly. As in FIG. 1, the frame lower plate is cut away to present with greater clarity the principal points of novelty. The machine elements used to coordinate the motion of die combination 4 and pivoting dies 5 are emphasized. A substantial amount of the secondary partial ring 3, which could be called a die carrier, has been cut away for clarity. Linkages 6 are retained on ring 3 by retaining elements 3*d* extending through slots 6*c* and the linkages. Driving cams 4*c*, situated on the die combination 4, engage cam follower surfaces 6*a* to move linkages 6 toward the driven pins 5*c* such that cam surfaces 6*b* will cause the pivoting dies 5 to rotate into position to grip the pipe. Die stops 3*c* prevent derangement of the machinery in the event it is actuated in the absence of a pipe. Bias springs 8 urge the cams to fold away into partial ring 3 to clear the throat 1*a*, so that the pipe may be removed from the position shown. The springs 8, one for each pivoting die, are shown symbolically in this small scale figure. FIG. 5, somewhat enlarged, more clearly shows the spring and die relationships.

Figure 3:
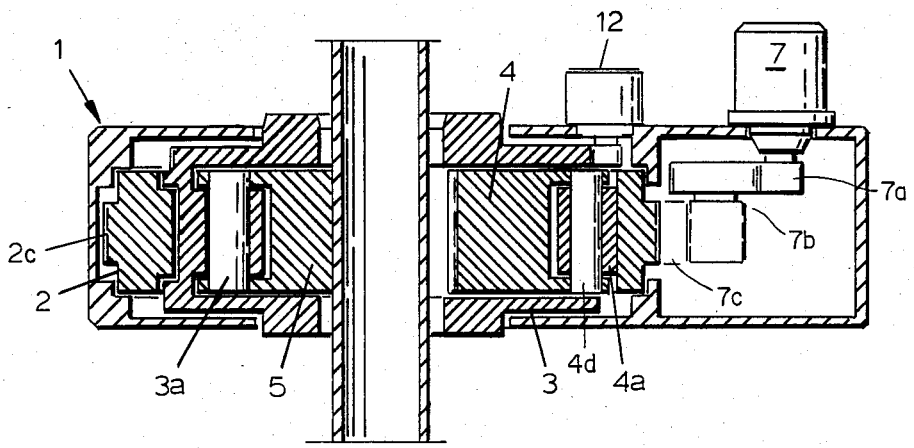
FIG. 3 represents a cutaway of the apparatus of FIG. 1 taken along lines 3—3.

FIG. 3 is the apparatus of FIG. 1 in partial cutaway, taken along lines 3—3. This figure is rather simplified in that no effort has been made to show the exact details of the bearing means usable to support ring 2 in housing 1. In this figure, partial ring 3, which could also be called a die carrier, is supported by rudimentry bearings in ring 2, primarily for clarity. Ring 3 must be capable of rotating within ring 2, and rotating many turns, if necessary, within frame 1. It is to be noted that the assembly comprising the directly associated elements of rings 2 and 3 can be fitted into conventional power tong housings typical of housing 1. Shown as a single assembly, primary drive motor and gear train 7 is fastened to frame 1 and leads all the way to ring gear 2*c*, which is associated with ring 2. This motor and throat negotiating gearing is well established in the art and is typified by U.S. Pat. No. 4,404,876 representing a typical power tong into which the novel pipe rotating elements of this invention can be installed. The drive motor is preferably hydraulic but may be any conventional motor capable of rotating the pipe. The secondary control system 12 is a drum brake system secured to housing 1 and arranged to retard rotation of the secondary partial ring by throat negotiating gearing similar to the primary drive system 7.

Current art in power tong structure requires rotational alignment of a plurality of throat-like openings to admit pipe and permit pipe removal. When the rotating assemblies within the frame have done their work, the need remains to return various elements to a throat alignment position. This is commonly done by using a directional ratchet stop with only one rotational stop position. The directional ratchet stop is currently selectable. In other words, if pipe is to be turned clockwise, the stop is selected to function on counterclockwise rotation at the one, throat aligned position. After running threads, the tongs are simply reversed and meet solid turning resistance only when the throat and throat-like openings are aligned for pipe removal. By using modern sensor techniques, the alignment can be carried out by many processes, all acceptable to the novel machine element arrangements of the apparatus of this invention.

Figure 4:
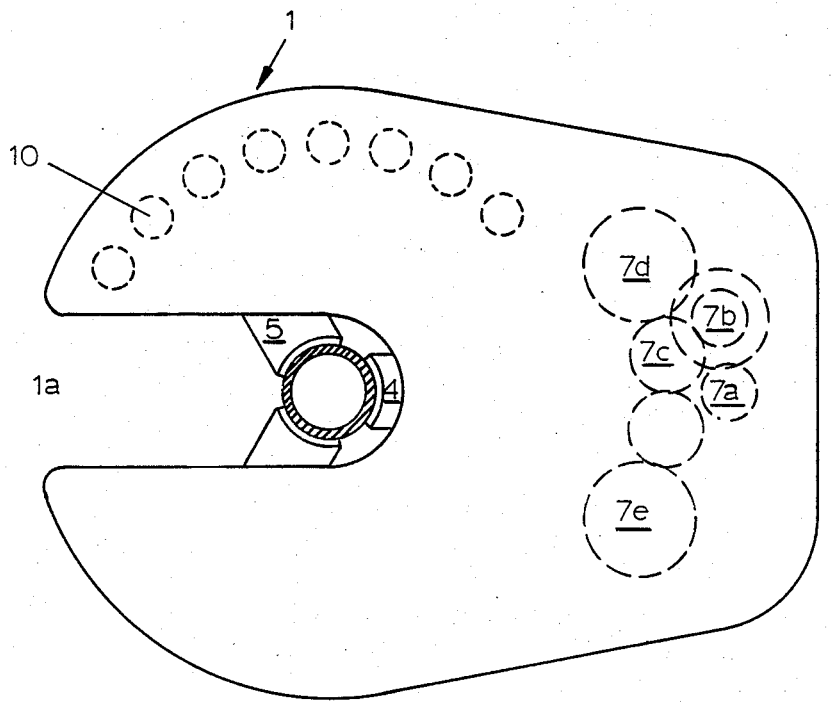
FIG. 4 represents a plan view of a typical assembly incorporating the apparatus of this invention.

FIG. 4 should be viewed more symbolic than in a practical structural sense. Frame 1 is as previously described, with throat 1*a* making entry of a pipe possible. Power train 7 consists of a motor and a first drive pinion 7*a*, gear and pinion 7*b*, and in turn gear 7*c*. Here, significantly, the power train is divided to drive idlers 7*d* and 7*e*. This divided train is necessary to engage the gear 2*c* on ring 2, because ring 2 has an opening which, in a complete revolution, would encounter one of the drive idlers and cause problems. With the two drive idlers, the ring gear 2*c* is picked up by one idler at the time the opening is encountered by the other idler.

Pivoting dies 5 and combination die 4 can be seen in the opening of the throat. They are in the position to grip the pipe. As shown, pivoting dies 5 would move out of the way as the pipe is inserted through the throat 1*a*. The pipe gripping and rotating assembly, as previously described, involving rings 2 and 3, is positioned within frame 1 by an assembly of rollers 10, fastened to either or both the upper and lower plates making up frame 1. Details of the pipe gripping machinery already described are eliminated from this figure.

Figure 5A:
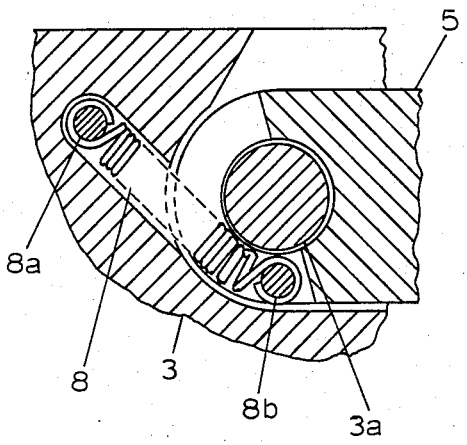
FIGS. 5A and 5B are plan views, somewhat enlarged, in partial cutaway of details related to spring 8 of FIG. 2.
Figure 5B:
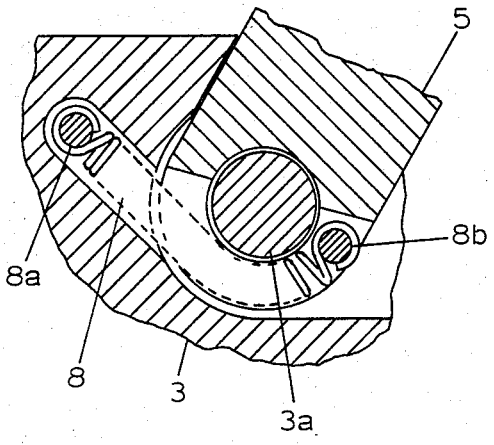

FIG. 5A shows somewhat enlarged details of the springs 8 that bias dies 5 out of the throat opening of partial ring 3. Space for springs 8 is provided by milled openings in partial ring 3 and in each die. The tension spring 8 has loops at each end that slip over pin 8*a* pressed into holes in partial ring 3 and over pin 8*b* pressed into holes in each pivoting die. When the dies are forced to pivot into the throat to grip pipe, the springs partially wrap pins 3*a* and maintain a restoring force on the dies.

Figure 6:
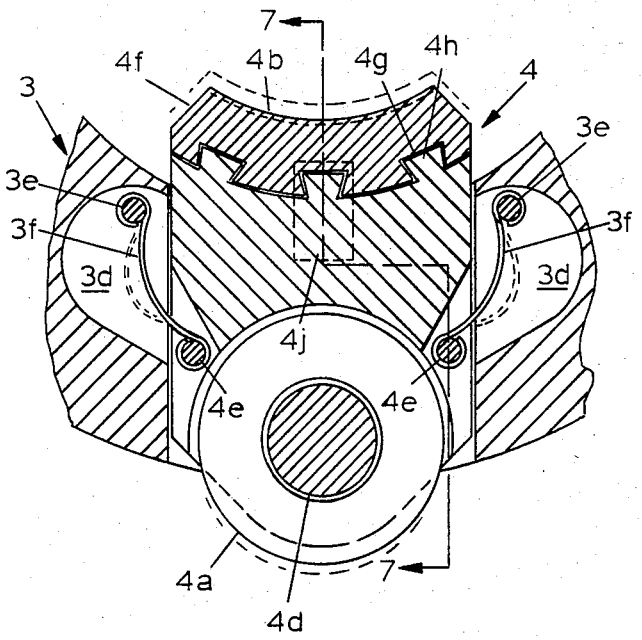
FIG. 6 is a plan view, partially cutaway, showing the cam follower combination 4 of FIG. 1, enlarged, in greater detail.
Figure 7:
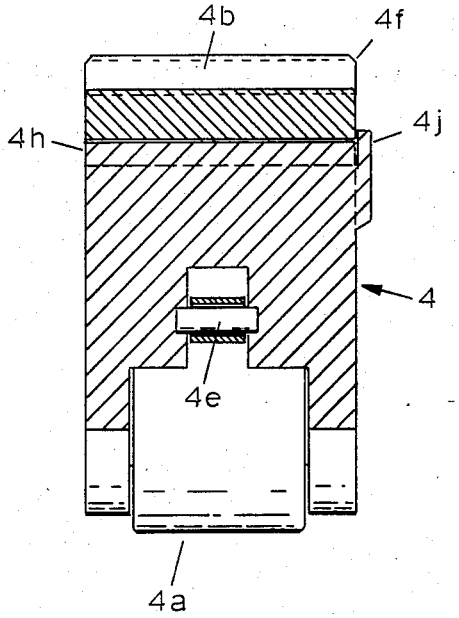
FIG. 7 is a view taken along line 7—7 of FIG. 6.

FIG. 6 shows the die combination 4 in the normal position in partial ring 3. Springs 3*f* are leaf springs with end rolled eyes that slip over pin 4*e*, situated in close fitting holes in the die combination mid-section and over pins 3*e* situated in close fitting holes in opening 3*d*, milled into partial ring 3. When die combiation 4 moves toward pipe, the springs loop out into opening 3*d* as shown by dotted lines.

Removable die insert 4*f* is typical of removable die inserts available in the oil field supply sources. Mating dovetails 4*g* and 4*h* are typical slip-in arrangements. The lug 4*j* is typically welded on to the combination mid-section to support the weight of the die inserts. The purchasable die inserts can be bought for various sizes of pipe. Surface 4*b* has a radius corresponding to the pipe to be served, and the surface 4*b* normally has serrated pipe contact surfaces. The dotted lines show a typical range of radial movement of the combination.

The same die insert mounting coutour is optionally provided on the pivoting dies 5. These are not shown because the mounting characteristics on the distal ends of the pivoting dies are identical to those on combination 4.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be imployed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A power tong for rotating a pipe to make up or break apart a threaded joint comprising:

(a) a frame having a throat for receiving pipe;

(b) a primary partial ring mounted on said frame for rotation relative to said frame about the pipe centerline, and having an opening therein, which is adapted to be aligned with said throat such that a pipe may be positioned within the aligned openings;

(c) cam surfaces on said primary ring opening toward the pipe centerline, generally symmetrical about a radial line extending in a direction opposite said opening from said pipe centerline, said surfaces so situated as to become progressively closer to said pipe centerline with each uniform amount of peripheral distance from said radial line in each peripheral direction;

(d) a secondary partial ring mounted for rotation about the pipe centerline, having an opening therein, which is adapted to be aligned with said throat such that a pipe may be situated therein, having a recess extending in the direction of said radial line with cam follower guiding surfaces to confine a cam follower free to move generally along said radial line;

(e) two pivots on said secondary ring with axes generally parallel to the pipe axis and situated approximately 120 peripheral degrees each side of said radial line;

(f) a cam follower and pipe gripping die combination situated in said cam follower guide surfaces for radial motion of such dimension that pipe gripping surfaces on a first end engage a pipe outer surface, when cam follower surfaces on a second end are in contact with said cam surfaces some peripheral distance from said radial line, due to relative rotation between said primary and said secondary ring;

(g) two pivoting pipe gripping die carriers situated to pivot about said pivots of such dimension that pipe gripping surfaces on a distal end engage the outer surface of a pipe, when the pipe is in the preferred position for rotation;

(h) linkage means to transmit motion between cooperating surfaces of said cam follower and cooperating surfaces of said pivoting pipe gripping die carriers, such that said pivoting elements are rotated from an open position, allowing pipe to be moved into and out of said throat when said cam follower is in a more radially outward position from the pipe to a position to grip said pipe when said cam follower is moved toward said pipe;

(i) means to forcefully rotate said primary partial ring relative to said secondary partial ring; and (j) to forcefully rotate said primary partial ring relative to said frame to rotate pipe.

2. The apparatus of claim 1 further provided with bias means to urge said pipe gripping die carriers into a position away from the pipe surface.

3. The apparatus of claim 2 further provided with independent bias springs for each die carrier, situated to urge said dies away from the pipe surface.

4. The apparatus of claim 1 further provided with means to prevent rotation of said secondary partial ring relative to said frame, when said primary partial ring is rotated to accomplish said relative rotation between said primary and said secondary partial rings.

5. The apparatus of claim 1 further providing means for attaching a separable pipe gripping die to a carrier to comprise said cam follower and pipe gripping die combination.

6. The apparatus of claim 1 further providing a replacable cam follower wear surface to comprise said cam follower and pipe gripping die combination.

7. The apparatus of claim 1 further providing a replaceable pipe gripping die to comprise part of said pivoting pipe gripping die carriers.

8. An improved pipe gripping and pipe rotating power tong utilizing conventional throated power tong frame, pipe rotating motor, and associated throat negotiating gearing driving the pipe rotating elements and brake arrangement to temporarily hold a die carrier structure against rotation, the improvement comprising:

(a) a power tong frame having a throat to accept pipe into an opening situated to accommodate pipe in position to be rotated, a motor on said frame operatively associated with throat negotiating gearing to drive a peripheral gear on a pipe rotating partial ring, bearing means to support said partial ring for rotation about a pipe centerline, releasable brake means to secure a secondary partial ring against rotation relative to said frame and selective stop means to stop at least one partial ring rotation, when said throat in said partial ring coincides with said frame throat;

(b) a primary partial ring mounted for rotation in said power tong frame about a pipe centerline, said primary partial ring comprising a throat opening extending radially through the side of said partial ring, cam surfaces opening toward said throat and extending in each peripheral direction from a radial line extending from said pipe centerline in a direction opposite said throat opening, said cam surfaces comprising cylindrical surfaces on each peripheral side of said radial line generated from a line parallel said pipe axis and situated between said pipe axis and said cam surface, a peripheral gear extending around the outer periphery of said partial ring to each side of said throat, and means to operatively associate with said bearing means on said tong frame;

(c) a secondary partial ring to serve as a cam follower carrier mounted for rotation relative to said frame about the pipe axis, said secondary ring comprising: a throat opening extending radially through the side to admit and accept pipe positioned for rotation, surfaces to cooperate with said brake, a recess extending in the direction of said radial line with cam follower guiding surfaces to confine a cam follower free to move along said radial line, and two pivots with axes generally parallel the pipe axis and situated approximately 120 peripheral degrees each side of said radial line;

(d) a cam follower and pipe gripping die combination situated in said recess for radial motion, of such dimension that pipe gripping surfaces on a first end engage a pipe outer surface when a cam follower surface on a second end is in contact with said cam surface some peripheral distance from said radial due to relatime rotation between said primary and said secondary rings;

(e) two pivoting pipe gripping die carriers situated to pivot about said pivots of such dimension that pipe gripping surfaces on a distal end engage the outer surface of a pipe, when the pipe is in position for rotation;

(f) linkage means operatively associated with said cam follower and said pivoting die carriers to synchronize movement such that said pivoting cam followers are pivoted into position to engage pipe when said pipe gripping surface of said cam follower approaches the pipe, and to cause said pivoting die carriers to pivot radially outward to clear pipe moving radially in said throat when said cam follower moves away from said pipe centerline.

9. The apparatus of claim 8 further providing bias means to urge said pivoting die carriers radially away from said throat.

* * * * *